US007380687B2

(12) United States Patent
FitzSimons et al.

(10) Patent No.: US 7,380,687 B2
(45) Date of Patent: Jun. 3, 2008

(54) WET AND DRY TOWEL DISPENSER

(75) Inventors: Ryan M. FitzSimons, Bedford, NH (US); Timothy Bassett, Dunbarton, NH (US); Timothy Collins, Lebanon, NH (US)

(73) Assignee: Nester, LLC, Manchester, NH (US)

( * ) Notice: Subject to any disclaimer, the term of this patent is extended or adjusted under 35 U.S.C. 154(b) by 432 days.

(21) Appl. No.: 11/111,321

(22) Filed: Apr. 21, 2005

(65) Prior Publication Data

US 2005/0247720 A1 Nov. 10, 2005

Related U.S. Application Data

(63) Continuation of application No. 10/448,617, filed on May 30, 2003, now Pat. No. 6,899,250.

(51) Int. Cl.
*A47K 10/24* (2006.01)

(52) U.S. Cl. ..... 221/45; 221/46; 221/61; 221/199

(58) Field of Classification Search ..... 221/45, 221/46, 61, 199
See application file for complete search history.

(56) References Cited

U.S. PATENT DOCUMENTS

| | | | | |
|---|---|---|---|---|
| 3,836,045 | A | 9/1974 | Duhy et al. | 221/63 |
| 4,017,002 | A | 4/1977 | Doyle et al. | 221/63 |
| 4,180,160 | A | 12/1979 | Ogawa et al. | 206/210 |
| 4,984,530 | A | 1/1991 | Dutton | 118/43 |
| 5,638,957 | A | 6/1997 | Brasier | 206/581 |
| 5,803,249 | A | 9/1998 | Harsanyi, Jr. et al. | 206/233 |
| 5,996,803 | A | 12/1999 | Thompson | 206/577 |
| 6,189,730 | B1 * | 2/2001 | McClymonds | 221/46 |
| 6,279,775 | B1 | 8/2001 | Parkes et al. | 221/63 |
| 6,346,153 | B1 | 2/2002 | Lake et al. | 118/423 |
| 7,293,738 | B2 * | 11/2007 | Grebonval et al. | 242/597.7 |
| 2001/0035416 | A1 | 11/2001 | Dodson | 220/524 |
| 2002/0162848 | A1 | 11/2002 | Na | 221/63 |
| 2004/0120988 | A1 * | 6/2004 | Masting | 424/443 |
| 2004/0124202 | A1 | 7/2004 | Mitchell et al. | 221/34 |
| 2004/0124203 | A1 | 7/2004 | Phelps | 221/34 |

OTHER PUBLICATIONS

PCT International Search Report mailed Jul. 6, 2005 received in corresponding PCT application No. PCT/US04/17068 (2pgs).
PCT Written Opinion mailed Jul. 6, 2005 received in corresponding PCT application No. PCT/US04/17068 (3 pgs).

* cited by examiner

*Primary Examiner*—Gene O. Crawford
*Assistant Examiner*—Timothy R Waggoner
(74) *Attorney, Agent, or Firm*—Grossman, Tucker, Perreault & Pfleger PLLC

(57) ABSTRACT

A wet and dry towel dispenser contains and dispenses both dry towels and wet towels (also referred to as towelettes or wipes). The dispenser includes coaxially located compartments for containing the dry towels and wet towels, preferably in a nested arrangement to use space most efficiently within the dispenser. One preferred embodiment of the dispenser has a substantially cylindrical shape and a removable cover on one end to allow the towels to be loaded into the respective compartments.

2 Claims, 9 Drawing Sheets

WET AND DRY TOWEL DISPENSER

CROSS REFERENCE TO RELATED APPLICATIONS

The present application is a continuation of Ser. No. 10/448,617 filed May 30, 2003 now U.S. Pat. No. 6,899,250, which is incorporated herein by reference.

TECHNICAL FIELD

The present invention relates to towel or towelette dispensers and more particularly, to a wet and dry towel dispenser in which the wet and dry towels are arranged to efficiently use the space within the dispenser.

BACKGROUND INFORMATION

Dispensers with wet or pre-moistened towels (also referred to as towelettes or wipes) have become common for a variety of uses ranging from personal hygiene (e.g., baby wipes) to cleaning and sanitizing (e.g., in an office, bathroom, kitchen or automobile). These dispensers maintain the moisture content of the wet towels while allowing individual wet towels to be conveniently dispensed. One example of such a dispenser is disclosed in greater detail in U.S. Pat. No. 4,017,002, which is incorporated herein by reference.

Although the wet towels provide a cleaning and sanitizing capability not provided by dry towels, there is often a need to use dry towels together with wet towels. For example, dry towels may be used to dry a surface after the surface has been cleaned with a wet towel. To satisfy this need, dispensers have been designed to hold and dispense both wet towels and dry towels. Examples of such dispensers are disclosed in greater detail in U.S. Pat. Nos. 6,189,730 and 5,803,249 and U.S. patent application Publication Nos. 20010019064 and 20010035416, which are incorporated herein by reference. The existing wet and dry towel dispensers, however, do not provide the wet and dry towels in a convenient package that can easily be packed or stored (e.g., in a diaper bag or in a drink holder of an automobile).

Accordingly, there is a need for a wet and dry towel dispenser in which the wet towels and dry towels are arranged more efficiently in a more convenient container.

SUMMARY

In accordance with one aspect of the present invention, a wet and dry towel dispenser comprises an elongate container having a longitudinal axis and an inner wall located within the container and dividing the container into a wet towel compartment and a dry towel compartment. The wet and dry towel compartments are coaxially located within the container along the longitudinal axis for receiving wet towels and dry towels, respectively. The wet and dry towel compartments have wet and dry towel passages, respectively, and a cap covers at least the wet towel passage.

In one embodiment, the wet and dry towel compartments are nested concentrically within the container. In another embodiment, the wet and dry towel compartments are stacked within the container. The container is preferably substantially cylindrical According to another aspect of the present invention, a wet and dry towel dispenser comprises an outer containing portion for containing dry towels and an inner containing portion nested within the outer containing portion for containing wet towels. The outer containing portion has a dry towel passage located in a side of the outer containing portion. The inner containing portion has a wet towel passage located in an end of the inner containing portion. The inner container portion is substantially sealed sufficient to maintain moisture in the wet towels.

According to a further aspect of the present invention, a wet and dry towel dispenser comprises a container including an outer wall defining an outer compartment for containing dry towels. The container includes a dry towel passage that opens to the outer compartment for dispensing dry towels. An inner wall is located within the container defining an inner compartment for containing wet towels. A cover is removably coupled to the container for allowing access to the outer compartment and the inner compartment. The cover includes a wet towel passage that opens to the inner compartment for dispensing wet towels.

According to yet another aspect of the present invention, a wet and dry towel dispenser comprises an elongate container having a longitudinal axis and defining wet and dry towel compartments. The wet and dry towel compartments are coaxially located within the container and have wet and dry towel passages, respectively. Dry towels are located in the dry towel compartment and extend through the dry towel passage. Wet towels are located in the wet towel compartment and extend through the wet towel passage. A cap covers at least the wet towel passage.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
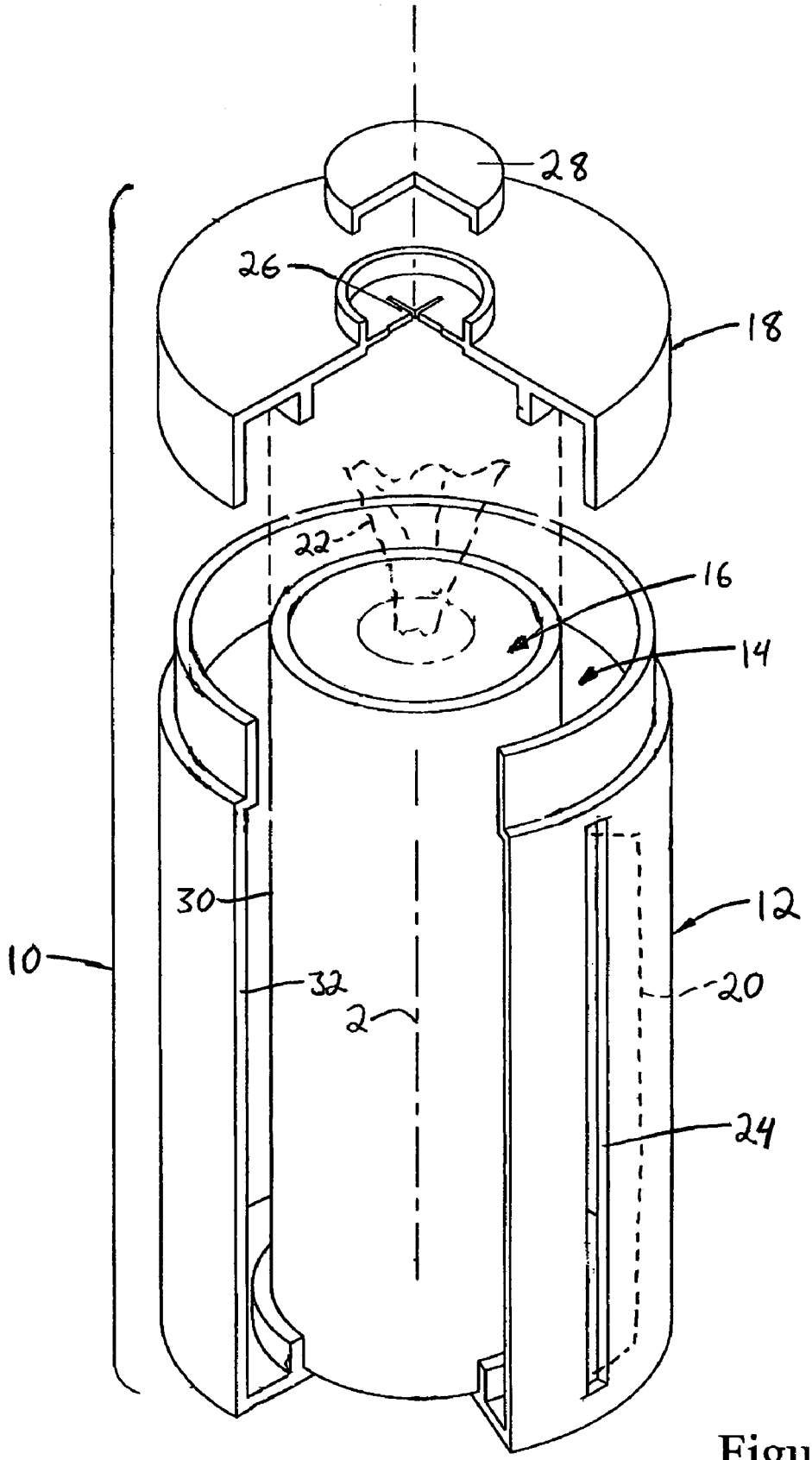
FIG. 1 is an exploded isometric view of the wet and dry towel dispenser with nested, concentric compartments, according to one embodiment of the present invention.

Referring to FIGS. 1-8, various embodiments of a wet and dry towel dispenser 10 are shown and described. In general, each of the embodiments of the wet and dry towel dispenser 10 includes an elongate container 12 having a longitudinal axis 2. The term elongate is used herein to mean having a longer dimension in the direction along the longitudinal axis 2 and a shorter dimension along the directions transverse to the longitudinal axis 2. A dry towel compartment 14 and a wet towel compartment 16 are coaxially located within the container 12 for holding the dry towels 20 and wet towels 22 (shown in fantom), respectively. The term towel is used broadly herein to refer to any type of absorbent cloth or paper including, but not limited to, towelettes and wipes.

The dry towels 20 and the wet towels 22 are dispensed through dry and wet towel passages 24, 26, respectively. The dry towel passage 24 and the wet towel passage 26 can have configurations similar to those used in conventional towel dispensers. In one preferred embodiment, the dry towel compartment 14 holds a roll of dry towels 20 in a manner that allows the towels to unroll when pulled through the dry towel passage 24 but without freely spinning. The dry towels 20 can also be arranged within the dry towel compartment 14 according to other techniques used in conventional towel dispensers. The wet towel compartment 16 is substantially sealed sufficient to maintain moisture in the wet towels 22. The wet towels 22 can be arranged within the wet towel compartment 16 according to techniques used in conventional wet towel dispensers.

Figure 3:
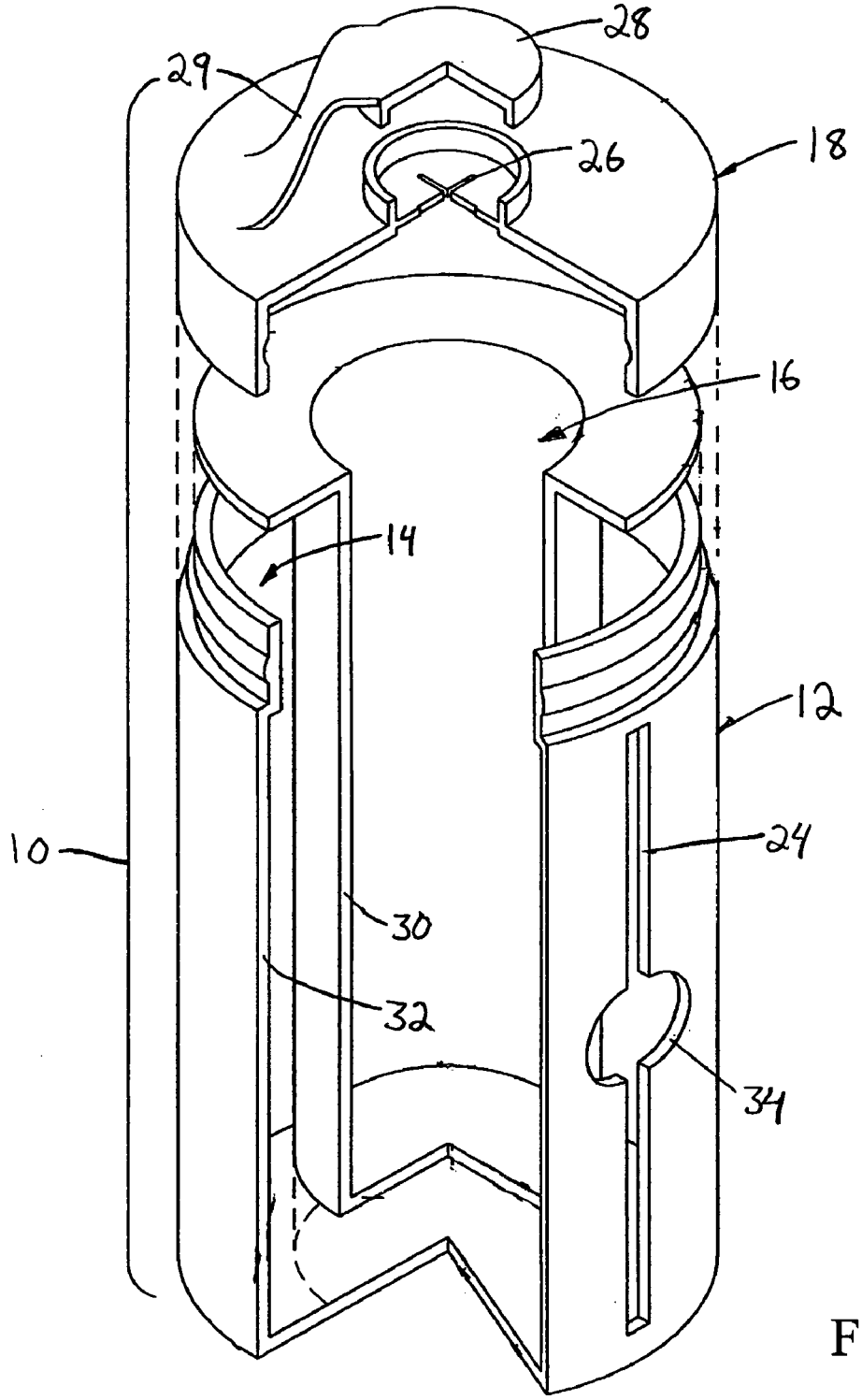
FIG. 3 is an exploded isometric view of the wet and dry towel dispenser with a removable nested compartment, according to a further embodiment of the present invention.

The container 12 is preferably substantially cylindrical in shape to provide the most efficient and convenient design, although other shapes are contemplated. The dispenser 10 preferably includes at least one removable cover 18 covering at least one end of the container 12 to allow the dry towels 20 and/or the wet towels 22 to be loaded into the container 12. A cap 28 is used to cover at least the wet towel passage 26 to prevent the wet towels 22 from drying out. In one embodiment, the cap 28 can be connected to the dispenser 10, for example, using a strap 29 connected to the cover 18 (FIG. 3). The dry towel passage 24 can also be sealed before use, for example, by using a removable foil or plastic barrier (not shown) adhered to the container and covering the dry towel passage 24. The removable foil or plastic barrier is removed to access the dry towels.

Figure 2:
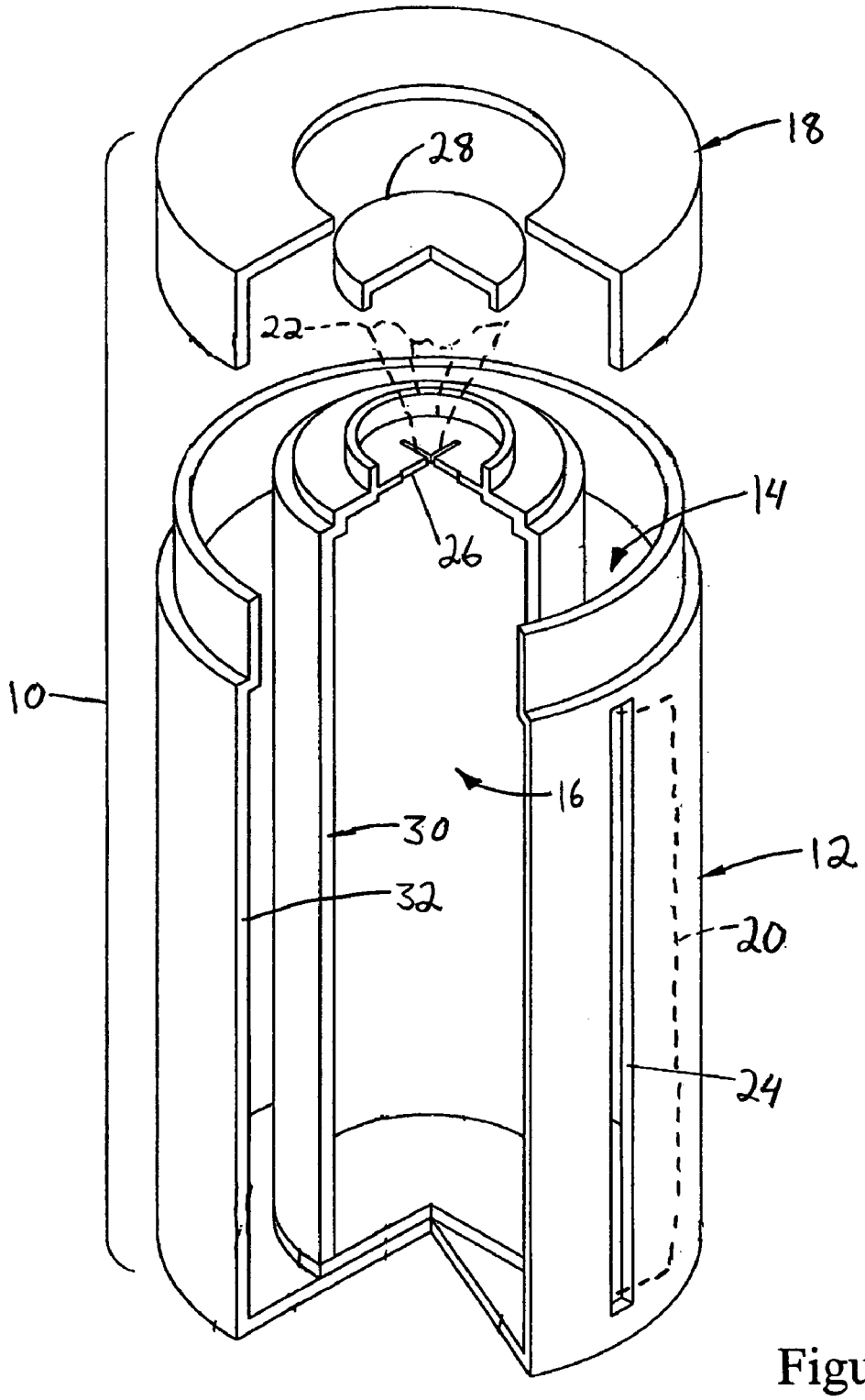
FIG. 2 is an exploded isometric view of the wet and dry towel dispenser with nested, concentric compartments, according to another embodiment of the present invention.

In the wet and dry towel dispenser 10, the compartments 14, 16 coaxially located within the container 12 can be in a nested arrangement or in a stacked arrangement. FIGS. 1-3 show various embodiments of the dispenser with nested, concentric compartments 14, 16. In these embodiments, the dispenser 10 includes an inner wall 30 and an outer wall 32 extending generally along, and preferably coaxial with, the longitudinal axis 2. The inner wall 30 together with the outer wall 32 define the dry towel compartment 14 or outer containing portion, and the inner wall 30 defines the wet towel compartment 16 or inner containing portion. The dry towels 20 are preferably rolled around the inner wall 30 with a free end of the dry towels 20 extending through the slot 24. In one embodiment, the inner wall 30 and wet towel compartment 16 (i.e., the inner containing portion) can be removable (FIG. 3).

Figure 1A:
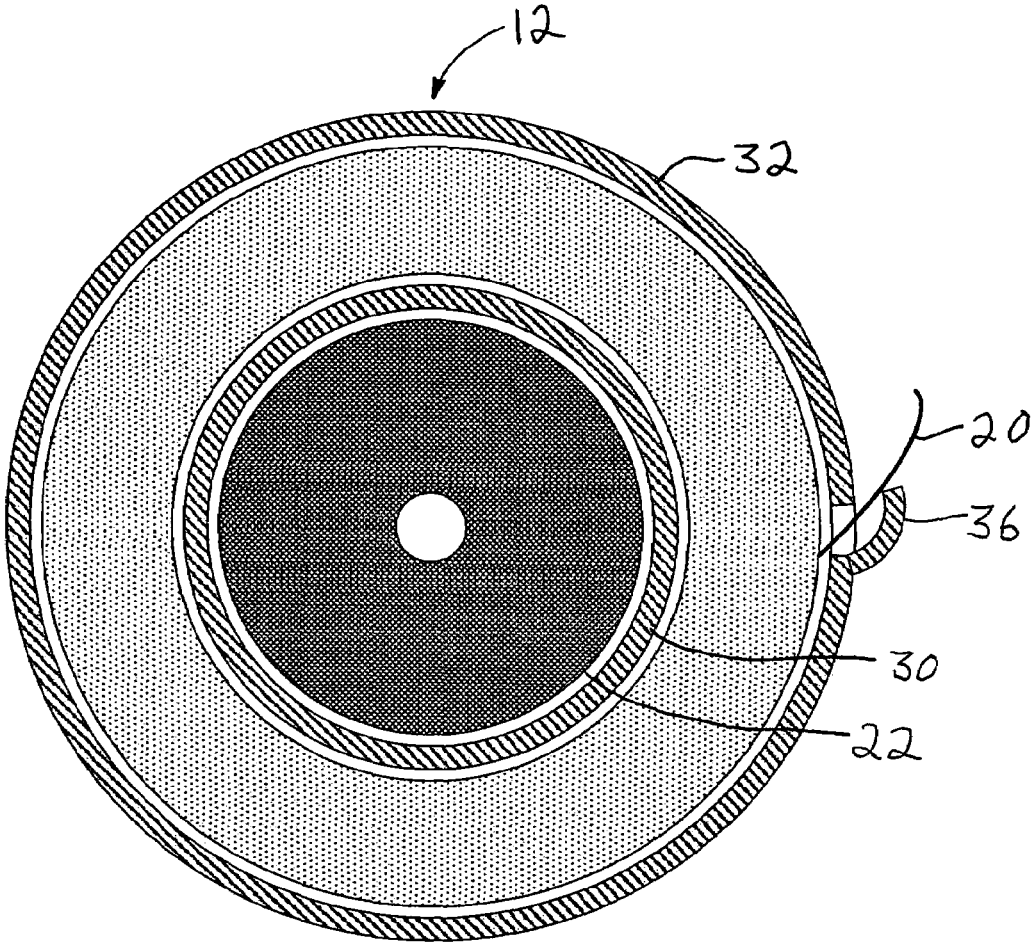
FIG. 1A is a cross-sectional view of the wet and dry towel dispenser with nested, concentric compartments, according to another embodiment of the present invention.

The dry towel passage 24 is preferably a slot located along the outer wall 32 and in this embodiment, extending substantially the length of the container 12. In one embodiment, a lip or hood portion 36 extends from the outer wall 32 of the container over the dry towel passage 24 to prevent debris or moisture from contaminating the dry towels 20 (FIG. 1A). In another embodiment, a hinged cover (not shown) is closed over the dry towel passage 24 when it is not in use and is opened to access the dry towels 20. In a further embodiment, the dry towel passage 24 includes a widened region 34 to allow fingers to grasp the end of the roll of dry towels 20 (FIG. 3). In yet another embodiment, a serrated edge (not shown) is formed or located along the dry towel passage 24 to facilitate tearing the dry towels 20.

The wet towel passage 26 is preferably located at an end of the dispenser 20. In one embodiment, the wet towel passage 26 can be located on the cover 18 (FIGS. 1 and 3). In an alternative embodiment, the wet towel passage 26 can be located at the end of the wet towel compartment 16 (FIG. 2). Other locations and configurations for the dry towel passage 24 and the wet towel passage 26 are also contemplated. For example, the wet towel passage 26 may also be located on the side of the container 12.

Figure 4:
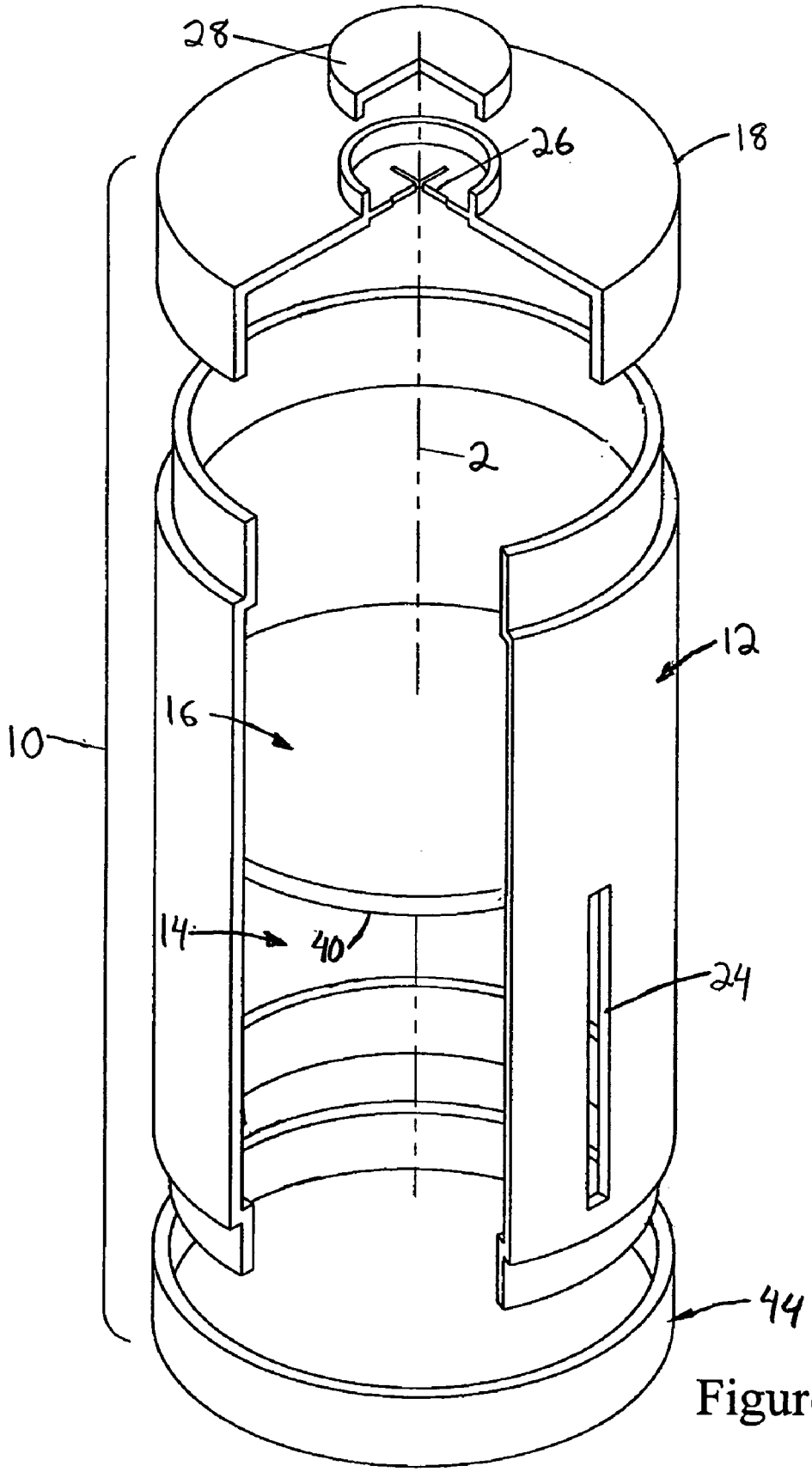
FIG. 4 is an exploded isometric view of the wet and dry towel dispenser with stacked compartments, according to one embodiment of the present invention.
Figure 5:
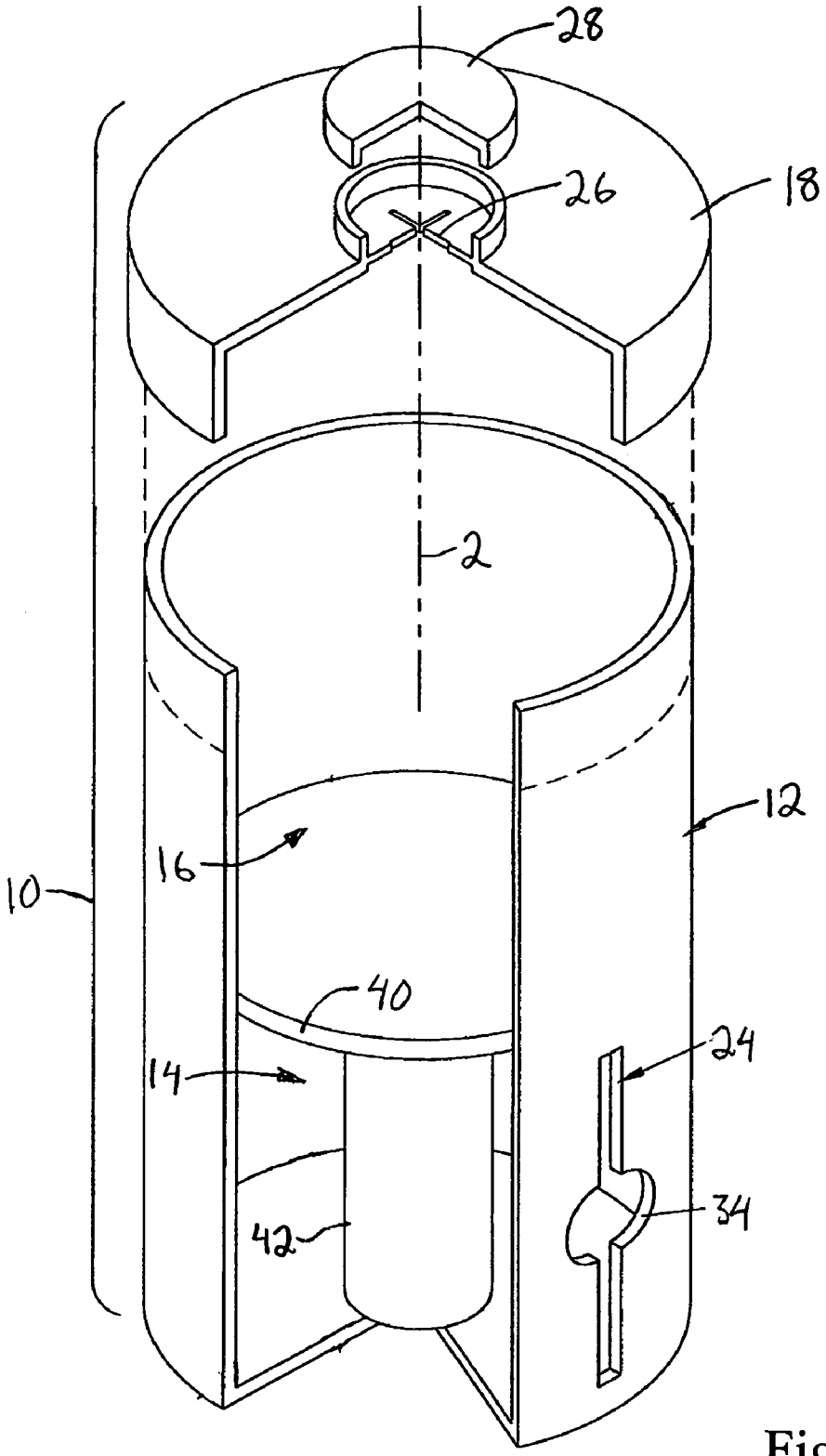
FIG. 5 is an exploded isometric view of the wet and dry towel dispenser with stacked compartments, according to another embodiment of the present invention.
Figure 6:
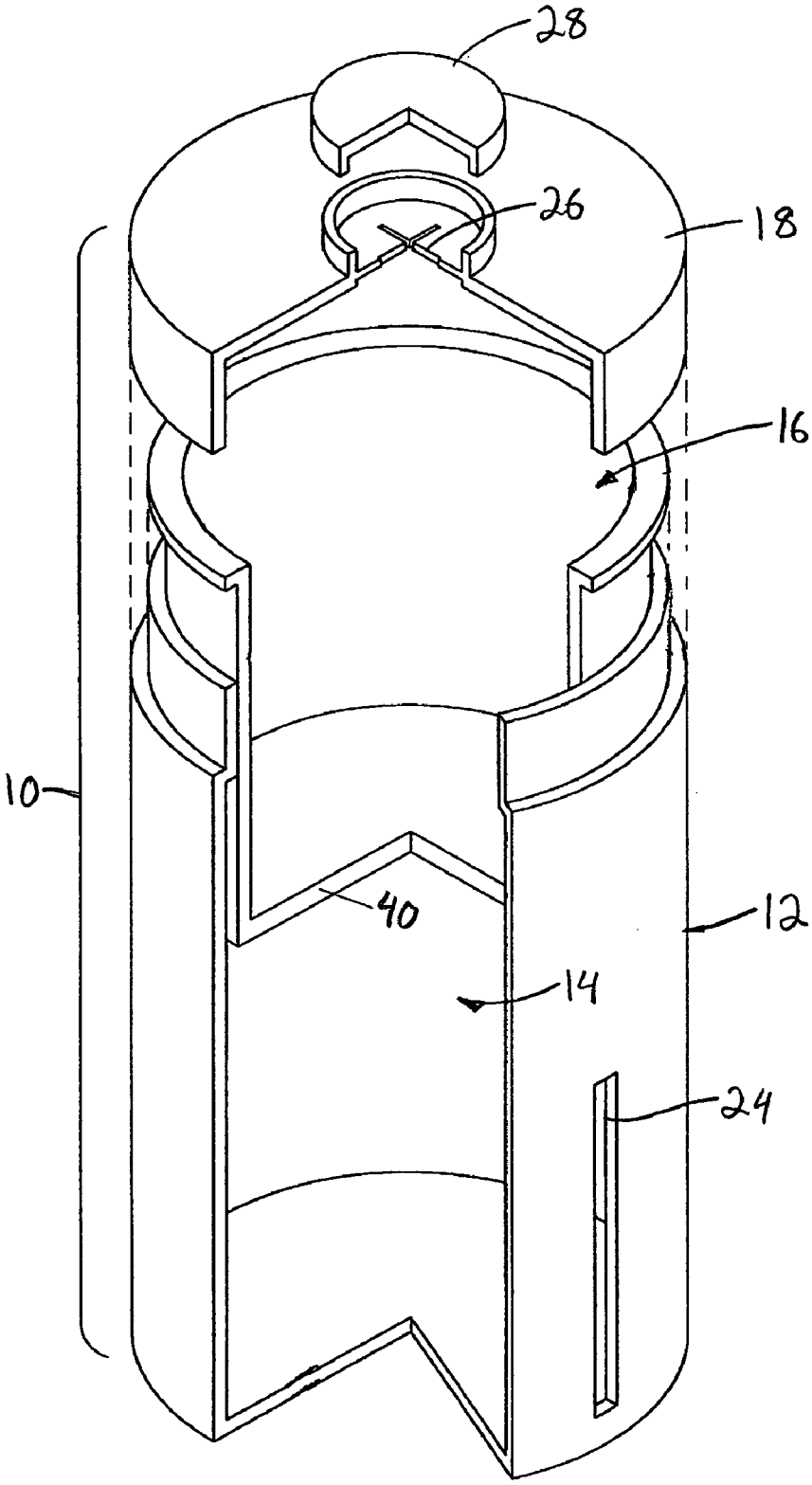
FIG. 6 is an exploded isometric view of the wet and dry towel dispenser with stacked compartments, according to further embodiment of the present invention.
Figure 7:
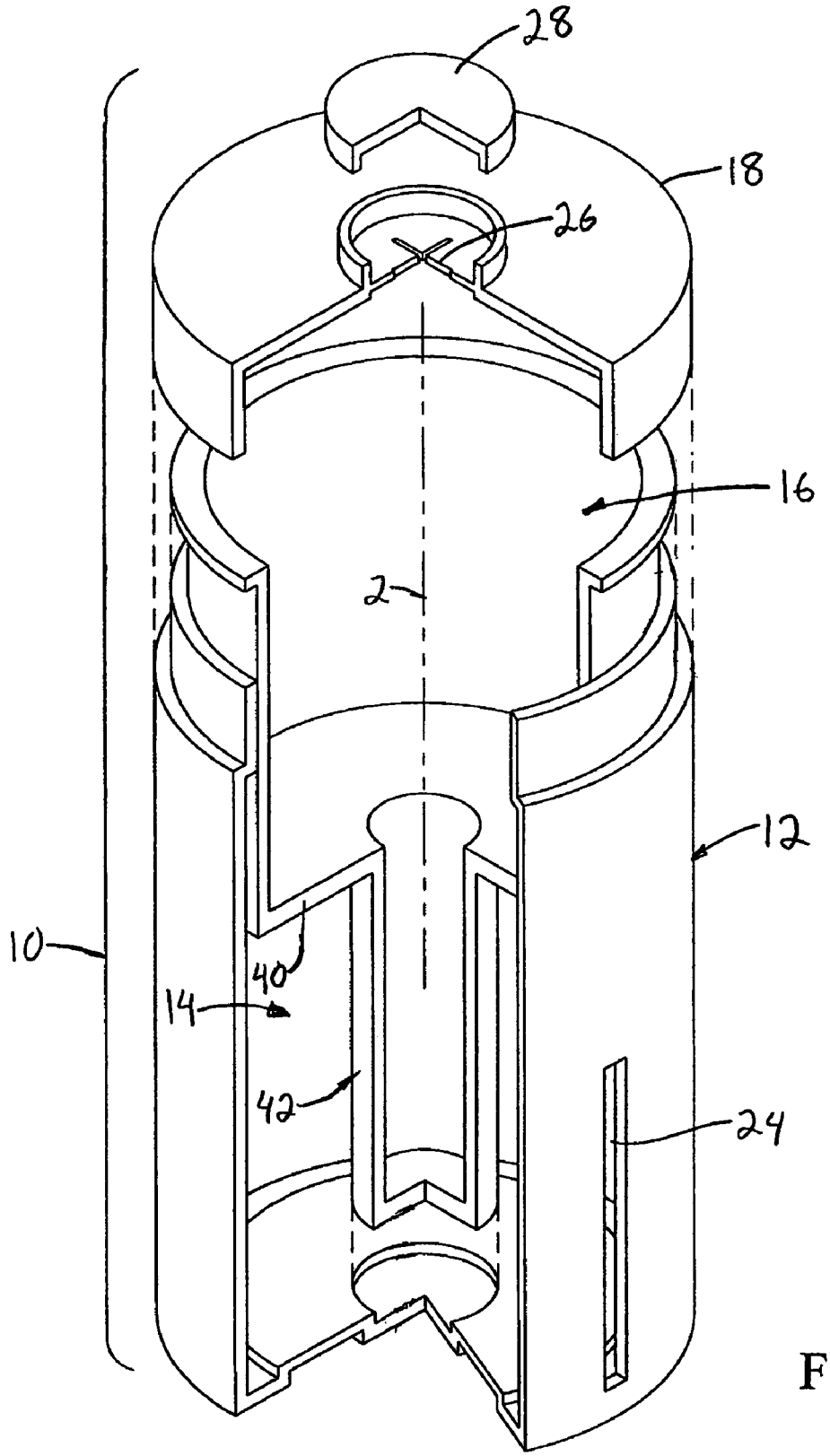
FIG. 7 is an exploded isometric view of the wet and dry towel dispenser with stacked compartments, according to yet another embodiment of the present invention.

FIGS. 4-8 show various embodiments of the dispenser 10 with the dry and wet towel compartments 14, 16 in a stacked arrangement coaxial with the longitudinal axis 2. In these embodiments, the dispenser 10 includes an inner wall 40 extending generally transverse to the longitudinal axis 2 for separating the dry towel compartment 14 or upper containing portion from the wet towel compartment 16 or lower containing portion. This embodiment of the dispenser 10 can also include a spindle 42 for the dry towels (FIGS. 5 and 7). In some embodiments, the inner wall 40 or wet towel compartment 16 can also be removable (FIGS. 6 and 7). An additional cover 44 can be used to cover the dry towel compartment 14 for loading the dry towels (FIG. 4).

In these embodiments, the wet towel passage 26 is preferably located at the end of the dispenser (e.g., in the cover 18), although other locations are contemplated. In these embodiments, the dry towel passage 24 is preferably a slot 24 extending along the length of the dry towel compartment 14. Although the dry towel compartment 14 and the wet towel compartment 16 are shown as having about the same length, other lengths are contemplated depending upon the respective volumes of dry and wet towels to be stored and dispensed.

Figure 8:
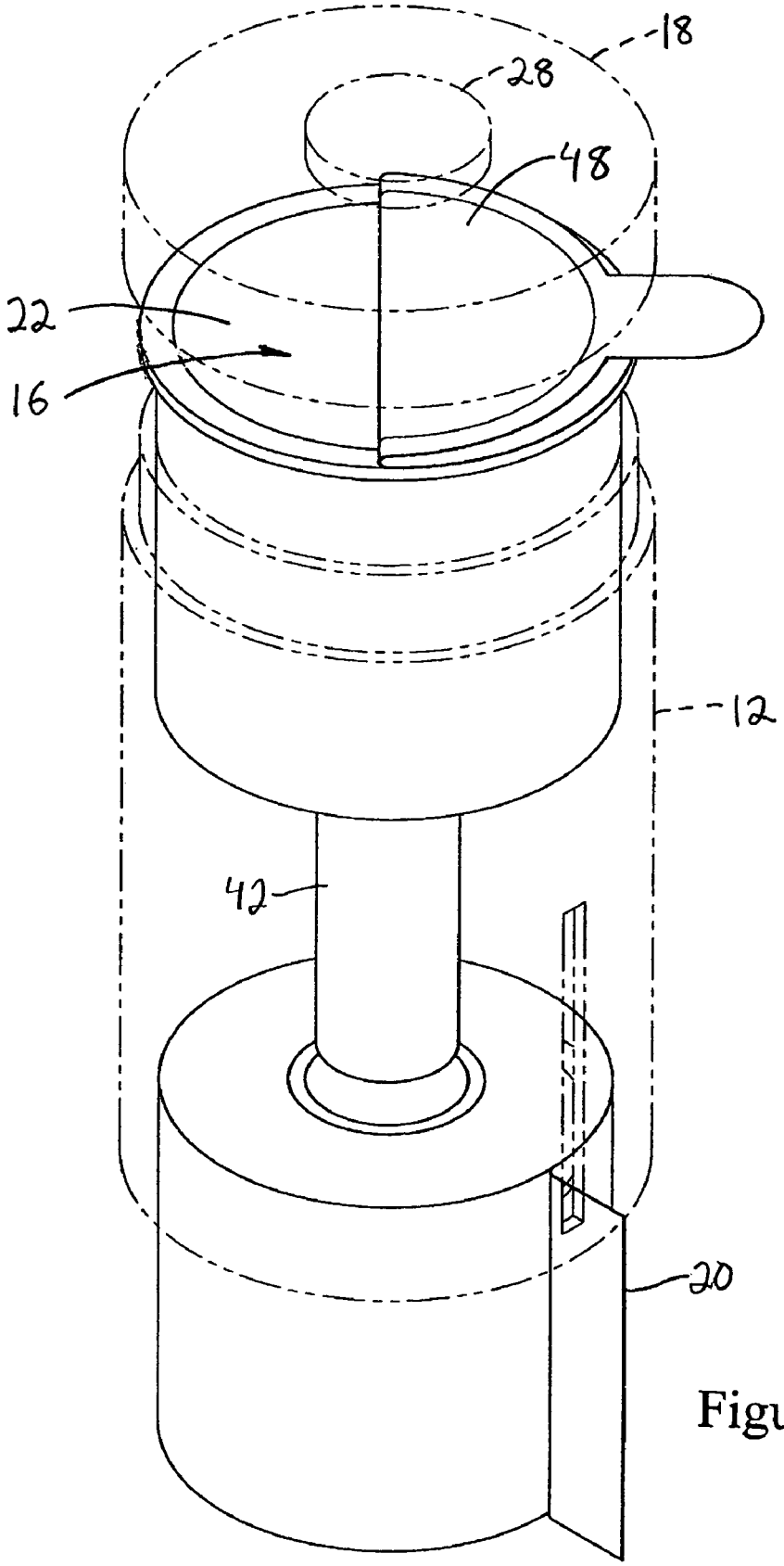
FIG. 8 is an exploded isometric view of the wet towels and the dry towels used in the dispenser shown in FIG. 7.

As shown in FIG. 8, one embodiment of the removable wet towel compartment 16 can be provided with wet towels 22 pre-packaged within the compartment 16. In this embodiment, a removable sheet 48 covers the compartment 16 to maintain the moisture content of the wet towels 22 until the wet towel compartment 16 is positioned within the container 12. Thus, the container 12 can be re-filled with both wet towels 22 and dry towels 20. This concept can also be applied to the dispensers 12 shown in FIGS. 1-3 with the nested, concentric compartments 14, 16.

The dispenser 10 can be made of a plastic or other suitable material. Although various sizes and dimensions are contemplated, the dispenser 10 is preferably sized to be portable and easily stored. For example, the diameter of the container 12 can have dimensions corresponding to a drink holder in an automobile. The coaxial arrangement of the dry towels 20 and the wet towels 22 within the elongate container 12 maximizes space and facilitates the portability of the dispenser 10.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

The invention claimed is:

1. A wet and dry towel dispenser comprising:

an elongate container having a longitudinal axis and defining a wet towel compartment and a dry towel compartment, said wet and dry towel compartments being coaxially located within said container and having wet and dry towel passages, respectively, and wherein the longitudinal axis passes through central regions of said wet towel compartment and said dry towel compartment;

dry towels located in said dry towel compartment, wherein said dry towels extend through said dry towel passage;

wet towels located in said wet towel compartment, wherein said wet towels extend through said wet towel passage;

a removable cover for said container for allowing said dry towels and said wet towels to be loaded into said container; and a cap for covering at least said wet towel passage.

2. The dispenser of claim 1 wherein said wet towel passage is located on said removable cover.

* * * * *